US007996929B2

(12) United States Patent
Good et al.

(10) Patent No.: US 7,996,929 B2
(45) Date of Patent: Aug. 16, 2011

(54) FLUSH TOILET

(75) Inventors: Mark D. Good, Wauconda, IL (US); Michael Juska, Ann Arbor, MI (US); Jason Smith, West Bloomfield, MI (US); Noah Dorsey, Ann Arbor, MI (US); Brian Kelly, Mason, MI (US)

(73) Assignee: Thetford Corporation, Ann Arbor, MI (US)

( * ) Notice: Subject to any disclaimer, the term of this patent is extended or adjusted under 35 U.S.C. 154(b) by 723 days.

(21) Appl. No.: 12/043,565

(22) Filed: Mar. 6, 2008

(65) Prior Publication Data

US 2008/0216224 A1 Sep. 11, 2008

Related U.S. Application Data

(60) Provisional application No. 60/893,256, filed on Mar. 6, 2007, provisional application No. 60/893,259, filed on Mar. 6, 2007, provisional application No. 60/893,288, filed on Mar. 6, 2007.

(51) Int. Cl.
*E03D 11/00* (2006.01)

(52) U.S. Cl. ..... 4/432; 417/440; 417/446

(58) Field of Classification Search ..... 4/431–433; 137/522–523; 417/440, 446
See application file for complete search history.

(56) References Cited

U.S. PATENT DOCUMENTS

| | | | | |
|---|---|---|---|---|
| 615,751 | A | | 12/1898 | Sands |
| 637,399 | A | | 11/1899 | Miles |
| 762,059 | A | | 6/1904 | Hooper |
| 866,368 | A | | 9/1907 | Landell et al. |
| 996,588 | A | | 6/1911 | Kennedy |
| 1,278,665 | A | * | 9/1918 | Hunter ..... 4/433 |
| 1,329,932 | A | * | 2/1920 | Sell et al. ..... 4/432 |
| 1,403,688 | A | * | 1/1922 | Hunter ..... 4/433 |
| 1,589,353 | A | | 6/1926 | Bock et al. |
| 1,650,370 | A | | 11/1927 | Mahoney |
| 1,798,805 | A | | 3/1931 | Peter |
| 1,866,298 | A | | 7/1932 | Didinger |
| 1,888,842 | A | | 11/1932 | Allan |
| 2,501,510 | A | | 3/1950 | Gross, Jr. |
| 2,598,002 | A | | 5/1952 | Langdon |
| 2,642,259 | A | | 6/1953 | Catlin |
| 3,035,274 | A | * | 5/1962 | Baughman ..... 4/432 |
| 3,122,156 | A | | 2/1964 | Kersh |
| 3,228,036 | A | * | 1/1966 | Gast et al. ..... 4/320 |
| 3,422,844 | A | | 1/1969 | Grise |
| 3,514,231 | A | | 5/1970 | Belden |
| 3,594,828 | A | | 7/1971 | Seek |
| 3,618,632 | A | | 11/1971 | Stevens |
| 3,663,970 | A | | 5/1972 | Drouhard, Jr. et al. |
| 3,675,774 | A | | 7/1972 | Roberts et al. |
| 3,822,720 | A | | 7/1974 | Souza |
| 3,842,445 | A | | 10/1974 | Jones |
| 4,319,366 | A | | 3/1982 | Baker, Jr. et al. |
| 4,426,062 | A | | 1/1984 | Bowron |

(Continued)

*Primary Examiner* — Charles Phillips
(74) *Attorney, Agent, or Firm* — Harness, Dickey & Pierce, P.L.C.

(57) ABSTRACT

A toilet system includes a toilet and a pump assembly. The toilet has a bowl and a base. The base has a hopper for receiving waste from the bowl. The pump assembly is operative for pumping a source of flush water to the bowl and for pumping the waste from the hopper. A first flexible conduit interconnects the pump assembly and the bowl. A second flexible conduit interconnects the pump assembly and the hopper. The pump assembly is flexibly interconnected to the toilet for independent positioning relative to the toilet.

22 Claims, 6 Drawing Sheets

U.S. PATENT DOCUMENTS

| | | | |
|---|---|---|---|
| 4,465,102 | A | 8/1984 | Rupp |
| 4,696,602 | A | 9/1987 | Daigle, Sr. et al. |
| 5,158,210 | A | 10/1992 | Du |
| 5,462,254 | A | 10/1995 | Muller |
| 5,924,452 | A | 7/1999 | Szpara et al. |
| 6,192,931 | B1 | 2/2001 | Guetersloh et al. |
| D468,015 | S | 12/2002 | Horppu |
| 6,851,448 | B2 | 2/2005 | Fujii |
| 7,028,981 | B2 | 4/2006 | Horton |

* cited by examiner

FLUSH TOILET

CROSS-REFERENCE TO RELATED APPLICATIONS

This application claims priority to U.S. Provisional Patent Application Nos. 60/893,256 (filed 6 Mar. 2007); 60/893,259 (filed 6 Mar. 2007); and 60/893,288 (filed 6 Mar. 2007), which applications are herein expressly incorporated by reference.

FIELD

The present teachings generally relate to flush toilets. More particularly, the present teachings relate to a pump operated flush toilet with a flexible waste arm.

DISCUSSION

The statements in this section merely provide background information related to the present disclosure and may not constitute prior art.

Pump operated flush toilets are known in the pertinent art. For example, Thefford Corporation of Ann Arbor, Mich. manufactures and sells a pump operated flush toilet under the mark HEADMATE®. While known pump operated flush toilets, including the HEADMATE®, have proven acceptable for their intended applications, there remains a need for continuous improvement in the pertinent art.

SUMMARY

According to one particular aspect, the present teachings provide a mode selector for a pump assembly. The pump assembly includes a first conduit defining a fluid inlet and a second conduit defining a fluid outlet. The first conduit is associated with a first one-way valve and the second conduit is associated with a second one-way valve. The mode selector includes a first portion and a second portion. The first portion is moveable between a first position and a second position. In the first position, a fluid path extending through the first and second conduits is open and in the second position the first portion closes the fluid path. The second portion is operative to maintain one of the one-way valves in an open condition when the first portion is moved to the second position so as to avoid the creation of a vacuum.

In accordance with another particular aspect, the present teachings provide a method of installing a toilet system. The method includes providing a toilet and providing a pump assembly. The toilet has a bowl and a base. The base has a hopper for receiving waste from the bowl. The pump assembly is operative for pumping a source of flush water to the bowl and for pumping the waste from the hopper. The method additionally includes interconnecting the pump assembly and the bowl with a first flexible conduit and interconnecting the pump assembly and the hopper with a second flexible conduit. The method further includes independently mounting the pump assembly relative to the toilet.

According to another particular aspect, the present teachings provide a toilet system including toilet flexibly coupled to a pump assembly. The toilet system includes a toilet having a bowl and a base. The bowl receives a source of flush water. The base defines a hopper for receiving waste from the bowl. The pump assembly is operative for pumping flush water to the bowl and for pumping waste from the hopper. A first flexible conduit connects the pump assembly and the bowl. A second flexible conduit connects the pump assembly and the hopper. The pump assembly is flexibly interconnected to the bowl and the base such that the pump assembly is mountable in various positions relative to the base.

According to yet another particular aspect, the present teachings provide a valve assembly including a mounting portion, a valve seat and a valve body. The mounting portion may include a first end and a second. The first and second ends may be both selectively mounted to a conduit defining a fluid path. The valve seat may be interconnected to the mounting portion. The valve body may be interconnected to at least one of the mounting portion and the valve seat for movement relative to the valve seat between a seated position and a closed position. The valve body may include a first side and a second side. The valve body may be operative to seal against back flow from the first side and open to positive pressures on the second side. The valve assembly may be selectively used to control flow in either of two opposing directions.

Further areas of applicability of the present teachings will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present teachings will become more fully understood from the detailed description and the accompanying drawings, wherein.

DESCRIPTION OF VARIOUS ASPECTS

The following description of various aspects of the present teachings is merely exemplary in nature and is in no way intended to limit the invention, its application or uses.

Figure 1:
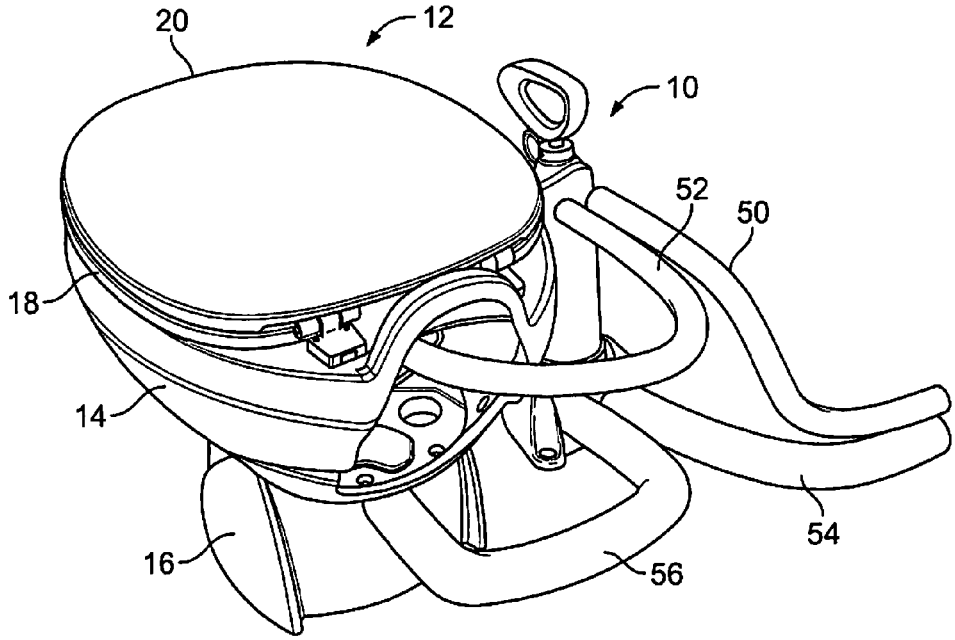
FIG. 1 is a perspective view of a pump operated flush toilet with a flexible waste arm in accordance with the present teachings.
Figure 2:
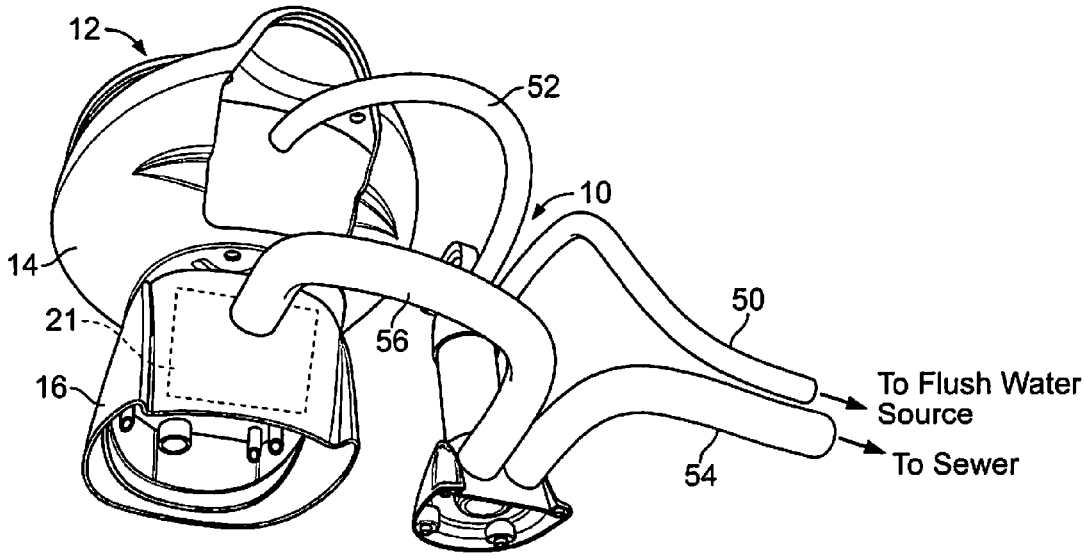
FIG. 2 is another perspective view of a pump operated flush toilet with a flexible waste arm in accordance with the present teachings.
Figure 3:
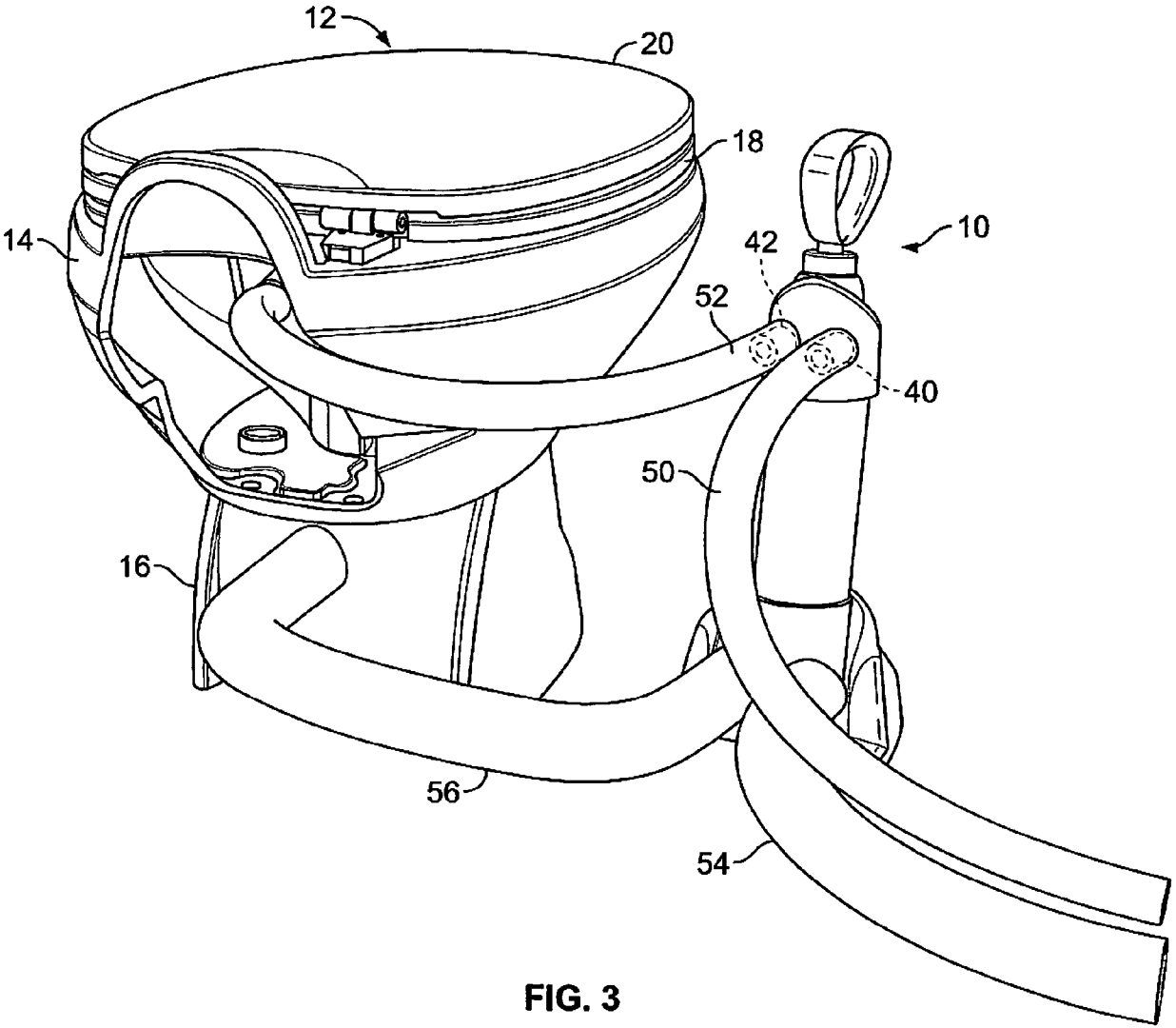
FIG. 3 is another perspective view of a pump operated flush toilet with a flexible waste arm in accordance with the present teachings.
Figure 4:
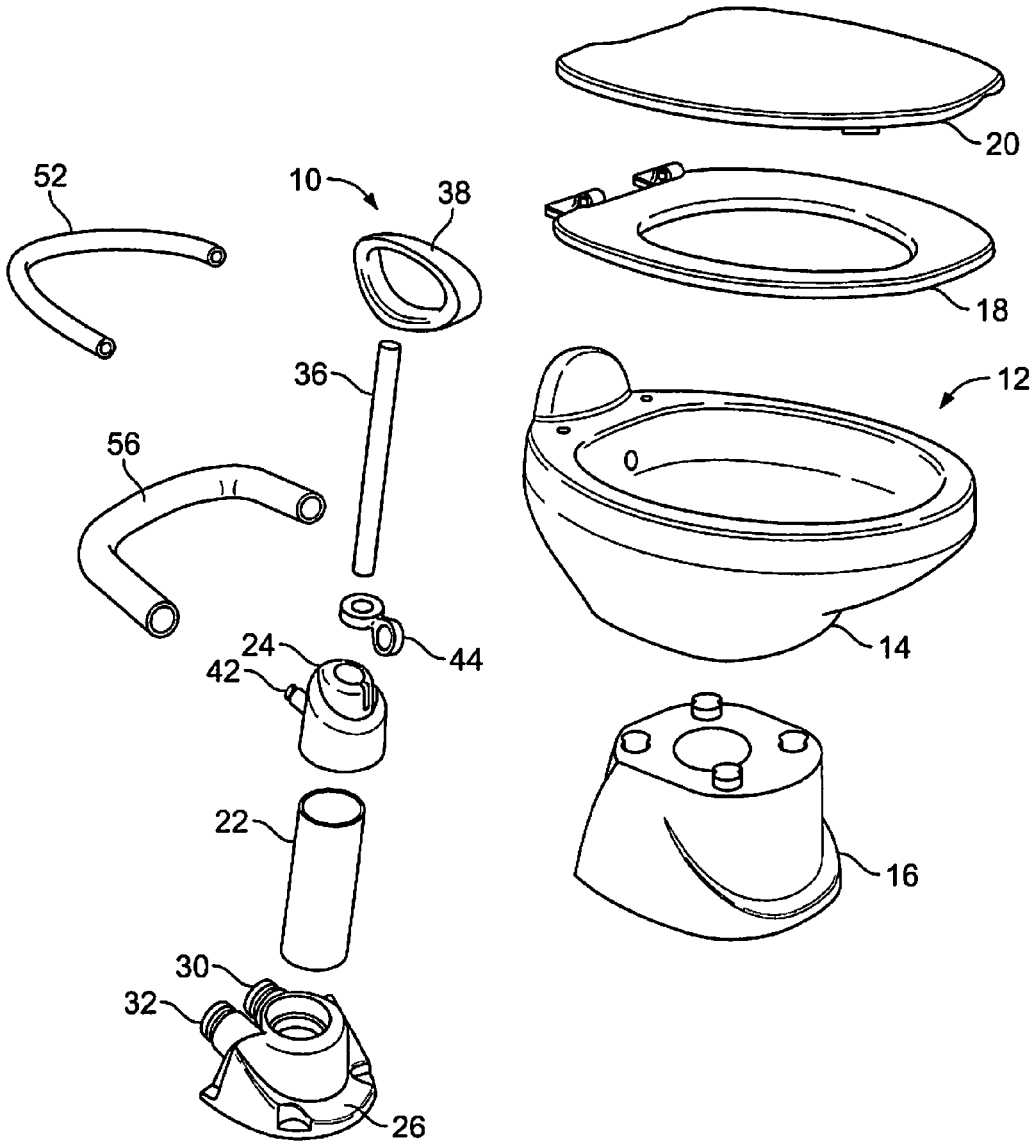
FIG. 4 is an exploded view of the pump operated flush toilet in accordance with the present teachings.

With general reference to FIGS. 1 though 4 of the drawings, a pump assembly in accordance with the present teachings is illustrated and generally identified at reference character 10. The pump assembly 10 is shown operatively associated with a toilet 12. It will be understood that the particular toilet 12 shown in the drawings is exemplary. In this regard, the pump assembly 10 of the present teachings may be used with other toilets 12 within the scope of the present teachings. Insofar as the present teachings are concerned, the toilet 12 will be understood to be of conventional construction and operation.

Before addressing the details of the pump assembly 10, a brief understanding of the cooperating features of the toilet 12 is warranted. The toilet 12 may generally include a bowl 14 and a base 16. The bowl 14 may be constructed of china. The base 16 may be constructed of plastic. The bowl and base 14 and 16 may be suitable secured to one other. Alternatively, the bowl and base 14 and 16 may be constructed of any other suitable materials known in the art. Still alternatively, the bowl and base 14 and 16 may be unitarily formed of a common material. A seat and cover 18 and 20 may be conventionally mounted to the bowl 14.

While not illustrated, it will be understood that the bowl 14 conventionally includes a nozzle for delivering a source of flush water. The base 16 may define a hopper 21. The hopper 21 may receive waste from the bowl 14 prior to transfer to a holding tank or sewer.

The pump assembly 10 may be a positive displacement pump and may include a pump body 22. The pump body 22 may be connected at an upper end to a pump cap 24 and at a lower end to a pump base 26. The base 26 may define a plurality of holes for receiving mounting fasteners. The base 26 may further define an input port 30 and an outlet port 32. The pump cap 24 may define an opening 34 for slidably receiving a pump rod 36. The pump rod 36 may be coupled to a pump handle 38. The pump cap 24 may further define a first conduit or flush water inlet port 40 and a second conduit or flush water outlet port 42.

The pump assembly 10 may be selectively operated in a plurality of modes. For example, the pump assembly 10 may be operated in a first mode in which a source of flush water is delivered to the bowl 14 of the toilet 12 and in which waste is pumped from the hopper 21 to a holding tank or sewer. The pump assembly 10 may be further operated in a second mode in which waste is pumped from a hopper 21 of the toilet 12 to the holding tank or sewer but flush water is not delivered to the bowl 14. The pump assembly 10 may include a mode selector lever 44 or other manual or electronic device for toggling between the first and second modes in a manner discussed below.

The pump assembly 10 may be coupled to the remainder of the waste transfer system in a flexible manner. In this regard, a first flexible hose 50 may interconnect the flush water source and the inlet port 40. A second flexible hose 52 may connect the outlet port 42 and the nozzle of the toilet 12. A third flexible hose 54 may connect the outlet port 32 and the holding tank or sewer. A fourth flexible hose 56 may connect the inlet port 30 and the hopper 21.

The present teachings allow for a wide variety of mounting choices for a pump assembly of a flush toilet. As such, a single toilet and single pump assembly may be utilized in a greater number of applications where space for mounting is limited or otherwise confined. Additionally, the present teachings provide for a non-directional design. In this regard, the present teachings may be configured as a right or left handed unit. Moreover, the present teachings use less material than conventional molded plastic waste arms, thereby reducing manufacturing costs and additional parts.

With continued reference to FIGS. 1-4 and additional reference to FIGS. 5 and 6, a mode selector constructed according to the teachings of the present disclosure will be described. The mode selector is illustrated and generally identified at reference character 110. The mode selector 110 is operative in a manner to be further discussed below to control the pump assembly 10 to operate in the first mode or the second mode in response to movement of the mode selector lever 44 or other device.

The flush water inlet port 40 and the flush water outlet port 42 may be associated with one-way valve assemblies 100. Insofar as the mode selector 110 is concerned, the one-way valve assemblies 100 may be of any suitable type operative to seal against back flow of fluid from the first side 102 and open to positive pressure on a second side 104. The particular valve assemblies 100 shown in the drawings offer certain advantages, however, and will be described further below. Briefly, a first type of one-way valve assembly 100A is shown associated with the pump assembly 10 in FIG. 5 and in the cross-sectional view of FIG. 7. A second type of one-way valve assembly 100B is shown associated with the pump assembly 10 in FIG. 6 and in the cross-sectional view of FIG. 8.

The mode selector 110 may include a first member or first portion 112 for closing the fluid path that extends through the inlet and outlet ports 40 and 42. The mode selector 110 may further include a second portion or second member 114 for maintaining one of the one-way valves 100 in an open condition so as to avoid the creation of a vacuum within the system. The first portion 112 may be moveable between a first or open position and a second or closed position. The open position is shown in FIG. 5, for example. The closed position is shown in FIG. 6, for example. The first portion 112 may be rotatable about an axis between the first and second positions. The axis may be defined by the pump rod 36.

The first portion 112 may carry or integrally define a seal portion 116. The seal portion 116 may be sized and positioned to seal one of the inlet and outlet ports 40 and 42 when the first portion 112 is rotated to the closed position. As shown in the drawings, the seal portion 116 may seal the inlet port 40. Alternatively, the seal portion 116 may seal the outlet port 42.

The second portion 114 may include a flexible member 118. The flexible member 118 may be in the form of a line, tether or similar structure. The flexible member 118 may be attached to or integrally formed with the first portion 112. The flexible member 118 may have a length sufficient to extend through one of the valves 100 when the first portion 112 is rotated to the closed position. As illustrated, the flexible member 118 may at least partially extend through the valve 100 associated with the outlet port 42 when the first portion 112 seals the inlet port 40.

Figure 5:
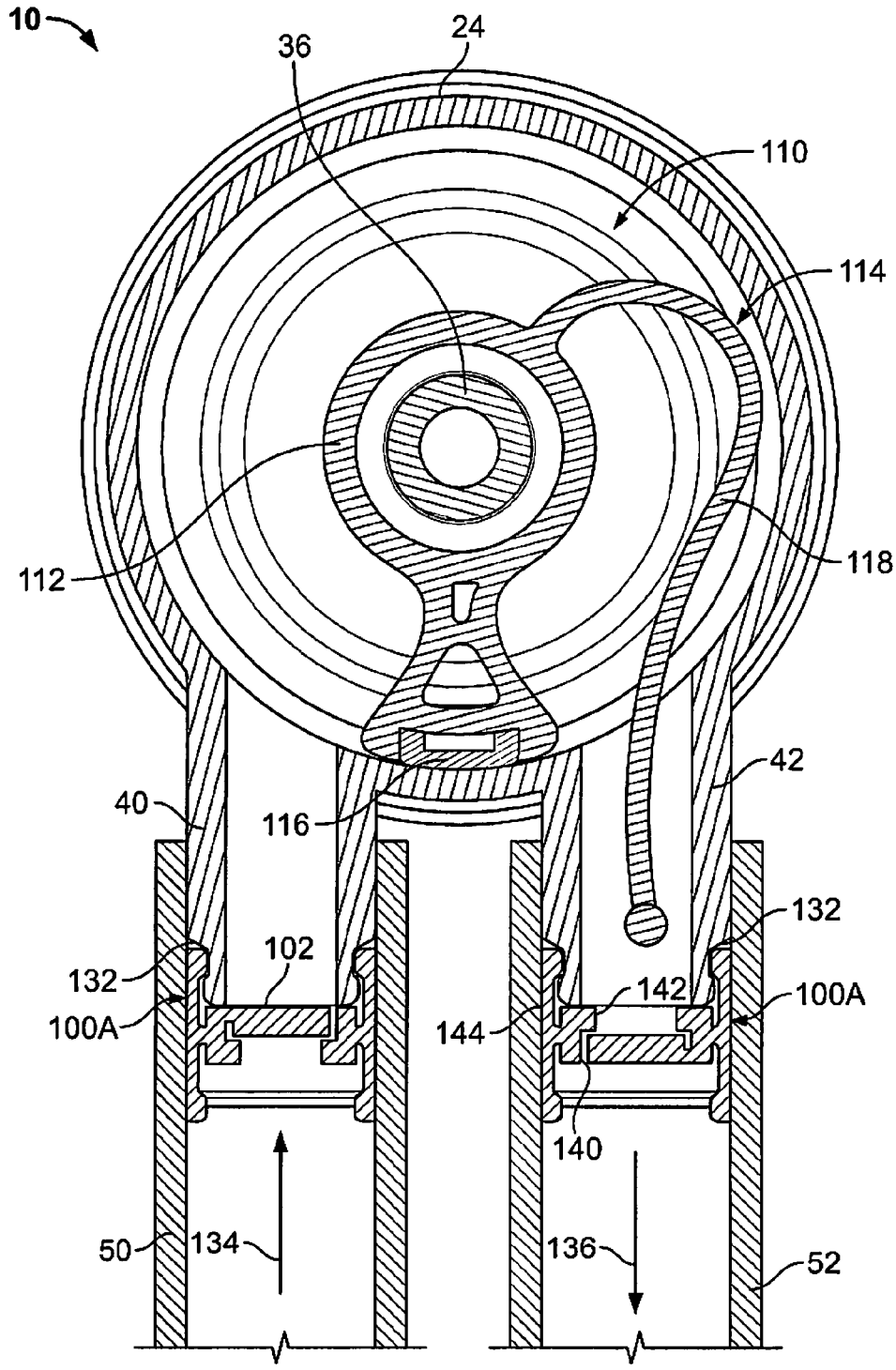
FIG. 5 is a cross-sectional view taken through the pump assembly at the flush water inlet and outlet ports and illustrating a flush mode selector for the pump assembly in accordance with the present teachings, the flush mode selector shown in an open position.

With particular reference to FIG. 5 in which the flush mode selector 110 is shown in the open mode, the first portion 112 is rotated to its corresponding open position. Fluid is now permitted to flow along the fluid path extending between the inlet port and the outlet port 40 and 42 and flush water is delivered to the bowl during pumping of the pump assembly 10. In this regard, fluid enters the inlet port 40 and exits the outlet port 42 in response to bi-directional motion of the pump rod 36. Further operation of the pump assembly 10 will be understood to be conventional insofar as the present teachings are concerned. The end of the flexible portion 118 does not extend through either of the valves 100 and the valves 100 are both permitted to normally function to allow one-way flow.

Figure 6:
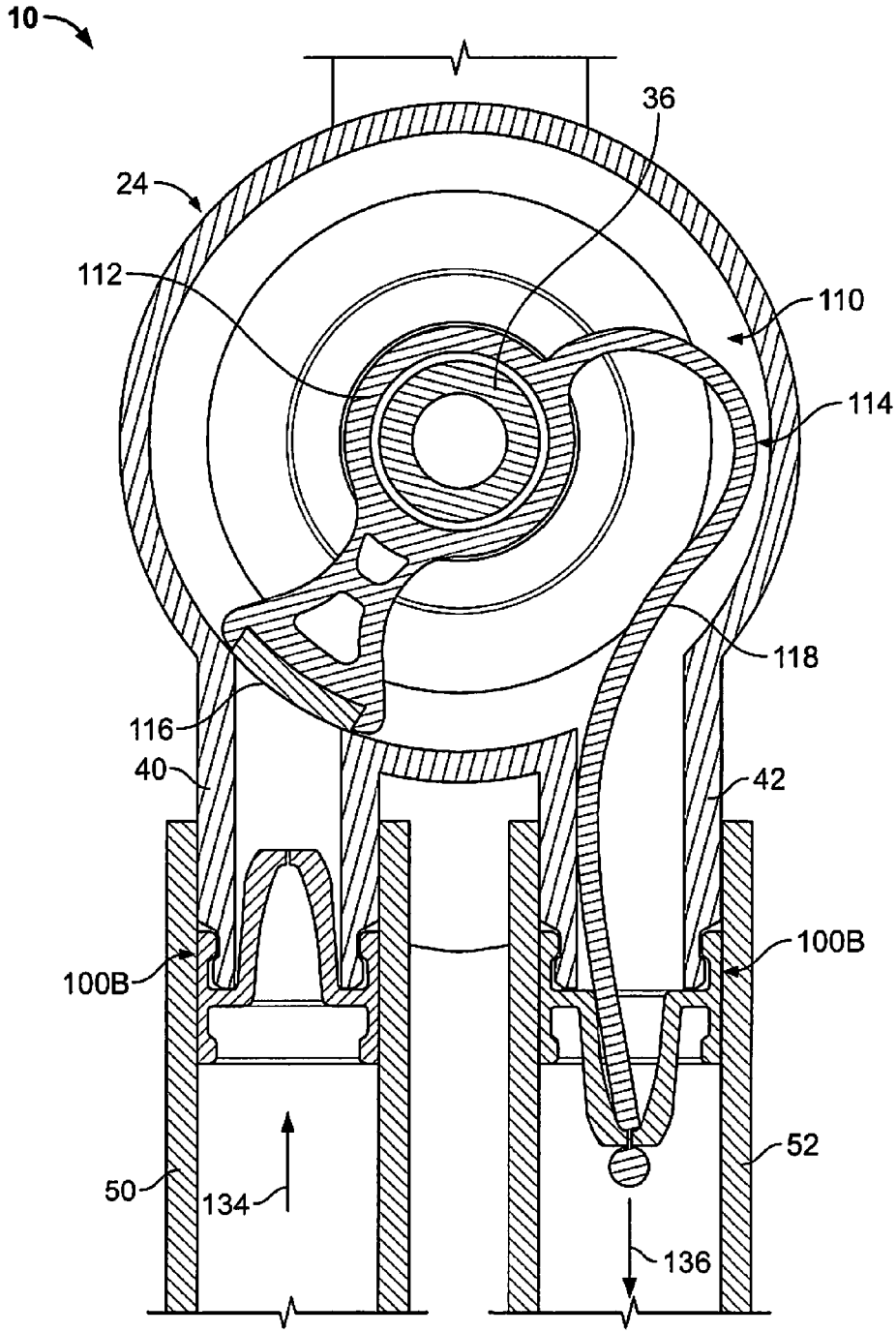
FIG. 6 is a cross-sectional view similar to FIG. 5, illustrating the flush mode selector in a closed position and incorporating alternate valve assemblies.

The flush mode selector 110 is shown in FIG. 6 in the closed mode. In this mode, the first portion 112 is rotated to its closed position and fluid is prevented from flowing along the fluid path extending between the inlet port 40 and the outlet port 42. The end of the flexible portion 118 extends at least partially through the valve 100 associated with the outlet port 42. In this manner, the flush water inlet port 40 of the pump assembly 10 is held shut and the outlet port 42 is held open, thus not allowing material to enter or exit the system, but at the same time not creating a vacuum within the system.

Figure 7:
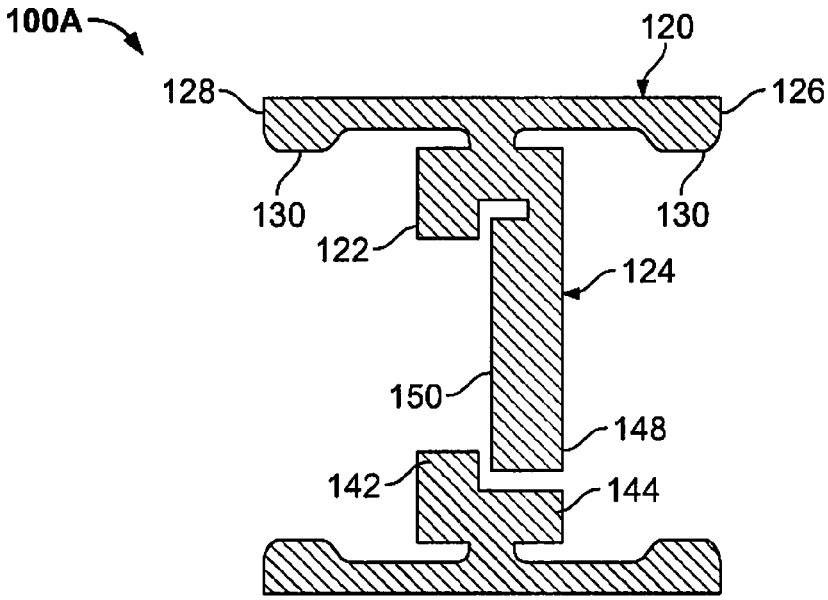
FIG. 7 is an enlarged cross-sectional view of one of the one-way valves of FIG. 5 shown removed from the pump assembly.
Figure 8:
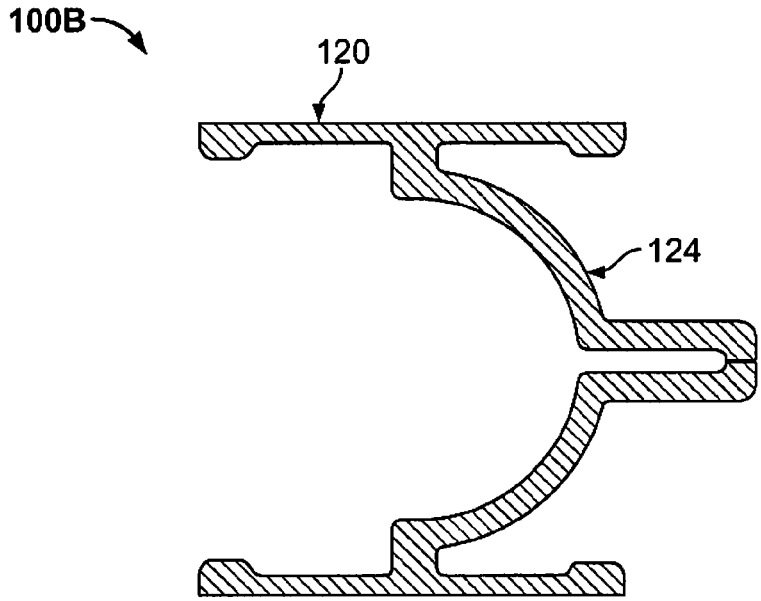
FIG. 8 is an enlarged cross-sectional view of one of the one-way valves of FIG. 6 shown removed from the pump assembly.

With additional reference to the cross-sectional views of FIGS. 7 and 8 of the drawings, the valve assemblies 100 constructed according to the teachings of the present disclosure will be further described. The valve assemblies 100 are particularly adapted for use in the pump assembly 10. Those skilled in the art, however, will appreciate that the teachings of the present disclosure are not limited to the exemplary applications shown in the drawings. In this regard, the valve assemblies 100 have applicability to other fluid transfer arrangements. As used herein, the term fluid will be understood to include liquid, gas and/or slurry type material, such as but not limited to sewage transferred from a toilet to a holding tank or sewer.

As particularly shown in the cross-sectional view of FIG. 7, the valve assembly 100A may generally include a mounting portion 120, a seating portion or valve seat 122 and a valve body 124. The mounting portion 120 may be generally cylindrical. Alternatively, the mounting portion 120 may be of any suitable geometry for mating with a conduit through which flow control is desired.

The mounting portion 120 may include a first end 126 and a second end 128. The first and second ends 126 and 128 may be generally identical to one another. The first and second ends 126 and 128 may both be selectively mounted to the inlet port 40 and the outlet port 42 depending upon the direction in which flow control is desired.

The first and second ends 126 and 128 may be formed to include retention features 130. The retention features 130 may be in the form of inwardly extending ribs 130. The ribs 130 may engage corresponding grooves 132 defined by the inlet port 40 and the outlet port 42. Alternatively, the ends 126 and 128 may be secured to the conduits 116 and 118 through a friction fit or any other manner well known in the art. As shown in FIG. 5, the first end 126 of one of the valve assemblies 100A is attached to the inlet port 40 to allow flow in a first direction 134. The second end 128 of another of the valve assemblies 100A is attached to the outlet port 42 to allow flow in a second direction 136.

The valve seat 122 is interconnected to the mounting portion 120. As shown in the cross-section view of FIG. 7, the valve seat 122 may simply define an inwardly extending circumferential flange against which the valve body 124 may seat. The valve seat 122 may include an axially extending portion 140 and an inwardly extending radial flange 142. These elements 140 and 142 may extend directly from the mounting portion 120 or be connected to the mounting portion 120 through a flange 144.

The valve body 124 may be interconnected to at least one of the mounting portion 120 and the valve seat 122 for movement relative to the valve seat between a seated position and a closed position. The valve body 124 may include a first side 148 and a second side 150. The valve body 124 is operative to seal against back flow from the first side 148 and open to positive pressures on the second side 150.

The valve assembly 100 may be unitarily constructed. In certain applications, the valve assembly 100 may be constructed of rubber. Other suitable materials may be employed within the scope of the present teachings.

With particular reference to FIGS. 6 and 8, the valve assembly 100B is shown to share various features in common with the valve assembly 100A. As such, like reference characters are used to identify similar elements throughout the drawings. The valve assembly may be a duck-bill type valve assembly 200. As such, the valve body 124 of the valve assembly 200 may be directly coupled to the mounting portion 120 without a seat portion 122. Other features of the valve assembly 200 may be identical to corresponding features described above with respect to valve assembly 100.

While one or more specific examples have been described in the specification and illustrated in the drawings, it will be understood by those skilled in the art that various changes may be made and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and the appended claims.

What is claimed is:

1. A toilet system comprising:

a toilet with a bowl and a base, the base defining a hopper for receiving waste from the bowl;

a pump assembly operative for pumping flush water to the bowl and for pumping waste from the hopper;

a source of flush water;

a first conduit connecting the pump assembly and the bowl;

a second conduit connecting the pump assembly and the hopper; and a third conduit connecting the pump assembly and the source of flush water;

wherein the pump assembly is operative in a first mode to open a fluid path extending through the pump assembly between the first conduit and the third conduit and further operative in a second mode to close the fluid path;

wherein the pump assembly further includes a mode selector having a first portion and a second portion, the first portion moveable between a first position and a second position such that in the first position the fluid path is open and in the second position the fluid path is closed, the second portion operative for maintaining a valve associated with one of the first and third conduits in a open condition when the fluid path is closed so as to avoid a vacuum in the pump assembly.

2. The toilet system of claim 1, further comprising a fourth conduit for interconnecting the pump assembly and a waste disposal area.

3. The toilet system of claim 1, wherein the waste disposal area is a sewer.

4. The toilet system of claim 1, wherein the waste disposal area is a holding tank.

5. The toilet system of claim 1, wherein the pump assembly is a positive displacement pump assembly.

6. A toilet system comprising:

a toilet having a bowl and a base, the base having a hopper for receiving waste from the bowl;

a pump assembly for pumping a source of flush water to the bowl and for pumping the waste from the hopper;

a first conduit interconnecting the pump assembly and the bowl;

a second conduit interconnecting the pump assembly and the hopper; and a third conduit interconnecting the pump assembly and the source of flush water;

wherein the pump assembly is operative in a first mode to open a fluid path extending through the pump assembly between the first conduit and the third conduit and further operative in a second mode to close the fluid path;

wherein the pump assembly further includes a mode selector having a first portion and a second portion, the first portion moveable between a first position and a second position such that in the first position the fluid path is open and in the second position the fluid path is closed, the second portion operative for maintaining a valve associated with one of the first and third conduits in an open condition when the fluid path is closed so as to avoid a vacuum in the pump assembly.

7. The toilet system of claim 6, further comprising a fourth conduit for interconnecting the pump assembly and a waste disposal area.

8. The toilet system of claim 7, wherein the waste disposal area is a sewer.

9. The toilet system of claim 7, wherein the waste disposal area is a holding tank.

10. The toilet system of claim 6, wherein the pump assembly may be flexibly positioned on either a right side or a left side of the toilet.

11. The toilet system of claim 6, wherein the pump assembly is a positive displacement pump assembly.

12. A method of installing and operating a toilet system comprising:

providing a toilet having a bowl and a base, the base having a hopper for receiving waste from the bowl;

providing a pump assembly for pumping a source of flush water to the bowl and for pumping the waste from the hopper, the pump assembly including a mode selector having a first portion and a second portion;

interconnecting the pump assembly and the bowl with a first flexible conduit;

interconnecting the pump assembly and the hopper with a second flexible conduit;

interconnecting the pump assembly and the source of flush water with a third flexible conduit;

independently mounting the pump assembly relative to the toilet;

operating the pump assembly in a first mode to open a fluid path extending through the pump assembly between the first flexible conduit and the third flexible conduit; and operating the pump assembly in a second mode to close the fluid path;

wherein the first portion of the mode selector is moveable between a first position and a second position such that in the first position the fluid path is open and in a second position the fluid path is closed, the second position operative for maintaining a value associated with one of the first and third conduits in an open condition when the fluid path is closed so as to avoid a vacuum in the pump assembly.

13. The method of claim 12, further comprising:

interconnecting the pump assembly and a waste disposal area with a fourth flexible coupling.

14. A toilet system comprising:

a toilet having a bowl and a base, the base including a hopper for receiving waste from the bowl; and a pump assembly for delivering a source of flush water to the bowl and for pumping waste from the hopper, the pump assembly operative in a first mode to deliver flush water to the bowl and pump waste from the hopper in response to pump actuation, the pump assembly operative in a second mode to pump waste from the hopper in response to pump actuation without delivering flush water to the bowl, the pump assembly including a first valve in fluid communication with the bowl and a second valve in fluid communication with a source of flush water, the pump assembly further including a mode selector disposed in the pump housing, the mode selector including a first portion and a second portion, the first portion blocking one of the first and second valves in the second mode, the second portion extending through the other of the first and second valves in the second mode to avoid a vacuum in the pump assembly.

15. The toilet system of claim 14, wherein the pump housing includes a waste inlet and a waste outlet, the waste inlet in communication with the hopper.

16. The toilet system of claim 14, wherein the first portion of the mode selector is moveable between a first position in which a fluid path extending between the first and second valves is open and a second position in which the fluid path is closed.

17. The toilet system of claim 16, wherein the first portion is rotatable between the first and second positions.

18. The toilet system of claim 14, wherein the second portion of the mode selector is a flexible member carried by the first portion.

19. The toilet system of claim 17, wherein the second portion is a tether.

20. The toilet system of claim 14, wherein the pump assembly is a positive displacement pump assembly.

21. The toilet system of claim 14, wherein the pump housing defines a fluid inlet associated with the first valve and a fluid outlet associated with the second valve.

22. The toilet system of claim 21, wherein the pump housing includes a main body portion and a cap, the cap defining the fluid inlet and fluid outlet.

* * * * *